United States Patent [19]

Del Toro et al.

[11] 4,105,064

[45] Aug. 8, 1978

[54] TWO STAGE COMPRESSOR HEATING

[75] Inventors: James J. Del Toro, Liverpool; Rudy C. Bussjager, Minoa, both of N.Y.

[73] Assignee: Carrier Corporation, Syracuse, N.Y.

[21] Appl. No.: 739,398

[22] Filed: Nov. 8, 1976

[51] Int. Cl.[2] ..... F25B 13/00

[52] U.S. Cl. ..... 165/29; 62/156; 62/175

[58] Field of Search ..... 62/156, 324, 276, 175; 165/29

[56] References Cited

U.S. PATENT DOCUMENTS

| | | | |
|---|---|---|---|
| 3,103,794 | 9/1963 | Kyle et al. | 165/29 X |
| 3,556,203 | 1/1971 | Kyle | 165/29 |

*Primary Examiner*—William E. Wayner

*Attorney, Agent, or Firm*—J. Raymond Curtin; Robert P. Hayter

[57] ABSTRACT

Electrical control means for use in a heat pump system having dual compressors wherein the operation of each compressor can be staged independently and automatically except for those periods when the outdoor heat exchanger is undergoing defrost wherein both compressors are placed in operation.

6 Claims, 3 Drawing Figures

TWO STAGE COMPRESSOR HEATING

BACKGROUND OF THE INVENTION

This invention relates to a heat pump control and in particular to a control system for regulating the operation of a heat pump employing dual compressors.

The term heat pump, as herein used refers to a reversible refrigeration system capable of delivering, on demand, either heating or cooling to an air conditioned region. In most smaller heat pump systems, a single compressor is employed. Control of the system is thus relatively simple and presents relatively few problems. However, in many larger heat pumps, two compressors are utilized with each compressor being arranged to pump refrigerant through an associated closed loop refrigeration circuit.

In heat pump systems using two compressors, it is the common practice to stage the operation of the compressors when the heat pump is in a cooling mode of operation whereby the compressors are brought into operation in sequence as the cooling load on the system increases. However, both compressors are normally operated when the system is providing heating to the air conditioned region without regard to the heating demands placed on the system. The operation of both compressors in the heating mode is carried out primarily to prevent the inadvertent cycling of one of the compressors when the system is undergoing a defrost cycle. As is well known in the art, starting one of the compressors when the indoor fan is off, as is typical during defrost, will force the system to operate under adverse conditions which could damage the system.

The continuous operation of both compressors to avoid the problems associated with defrosting, however, gives rise to other problems which, although not as dramatic, can also lead to the needless wasting of energy and eventual failure of the system.

SUMMARY OF THE INVENTION

It is therefore an object of the present invention to improve heat pump devices utilizing more than one refrigeration circuit.

A further object of the present invention is to improve control systems for use in heat pump devices employing multiple compressors.

It is yet another object of the present invention to provide a multiple compressor heat pump unit wherein the operation of each compressor is regulated in an ordered sequence in both the heating and cooling modes of operation to prevent damage to the equipment.

Another object of the present invention is to reduce the amount of energy consumed by heat pump units employing multiple compressors.

These and other objects of the present invention are attained in a heat pump having dual compressors, an indoor heat exchanger for providing heating and cooling to a conditioned region, defrost means for removing ice from the outdoor exchanger, thermostat means for sequentially starting the compressors in response to a rise or fall in temperature within the conditioned region circuit means for activating the defrost means to initiate a defrost cycle and simultaneously therewith starting the second compressor in the sequences by overriding the thermostat, first and second switches in the defrost circuit which when closed, energizes the circuit, means to close the first switch when the first compressor in the sequence is activated and thermal sensitive means for closing the second switch when the outdoor heat exchanger is subjected to icing conditions thereby insuring that both compressors are in operation when a defrost cycle is initiated.

BRIEF DESCRIPTION OF THE DRAWINGS

For a better understanding of the present invention as well as other objects and further features thereof, reference is had to the following detailed description of the invention to be read in conjunction with the accompanying drawings wherein.

DESCRIPTION OF THE PREFERRED EMBODIMENT

Figure 1:
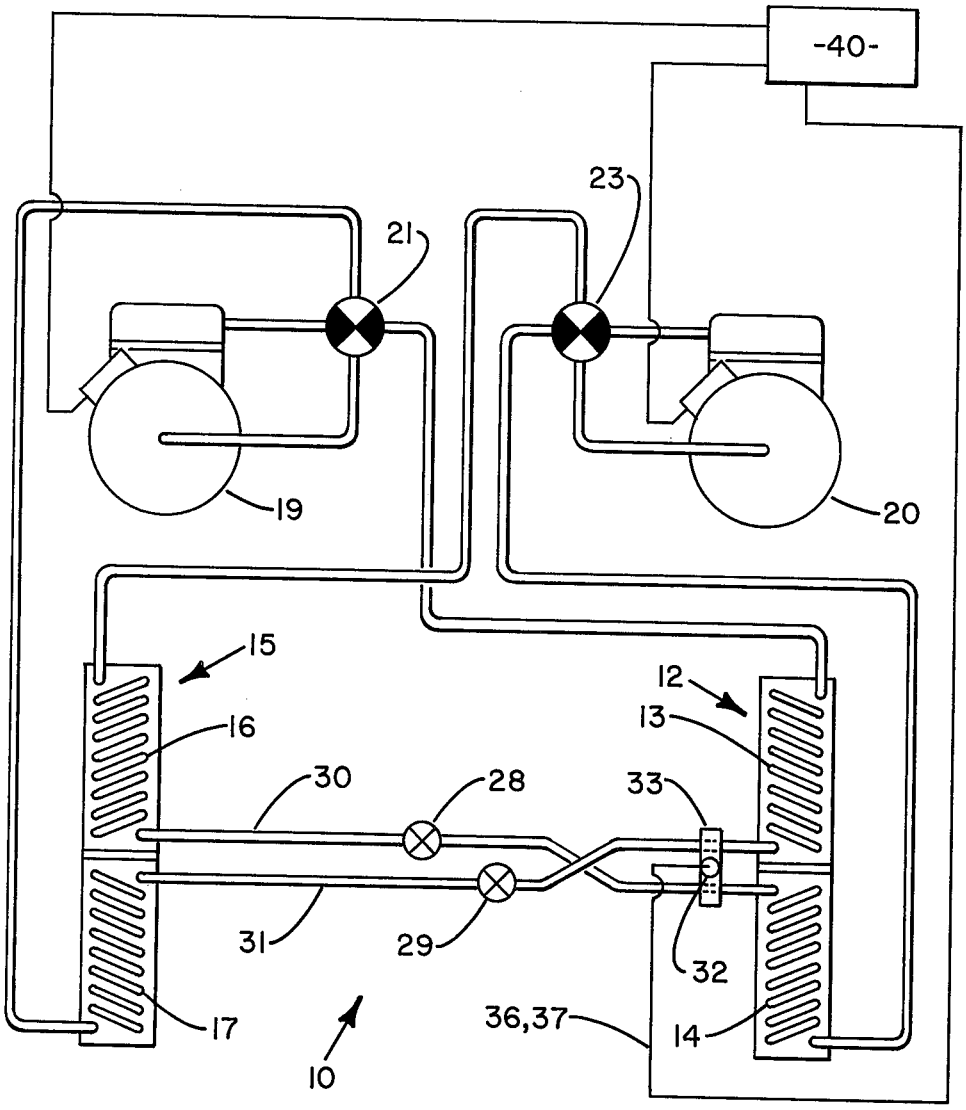
FIG. 1 is a schematic representation of a heat pump unit employing multiple compressors.

Referring initially to FIG. 1, there is depicted in schematic form a heat pump system, generally referenced 10, for providing, upon demand, both heating and cooling to a region requiring conditioned air such as a residential dwelling or the like. The heat pump system contains two individual closed loop refrigeration circuits, each of which is driven by its own compressor. As will be explained in greater detail below, the operation of each compressor is staged in a prescribed manner to efficiently meet the heating and cooling demands placed upon the system. As viewed in FIG. 1, the heat pump system includes two compressors 19 and 20; and outdoor heat exchanger 12 containing an upper coil 13 and a lower coil 14; and an indoor heat exchanger 15 also containing an upper coil 16 and a lower coil 17.

Compressor 19 is operatively associated with a first refrigeration circuit made up of lower coil 17 of the indoor heat exchanger and upper coil 13 of the outdoor heat exchanger via a solenoid actuated four-way reversing valve 21. Similarly, compressor 20 is operatively associated via a second solenoid actuated four-way reversing valve 23 with the lower coil 14 of the outdoor heat exchanger and the upper coil 16 of the indoor heat exchanger. Suitable expansion devices 28, 29, as known and used in the art, are operatively positioned in refrigeration lines 30, 31 extending between the two heat exchangers for throttling refrigerant from the high pressure side of each circuit to the lower pressure side thereof.

As is conventional in heat pump equipment of this type, the outdoor heat exchanger acts as a condenser when the heat pump is operating in the cooling mode and as an evaporator when it is operating in the heating mode. It should be clear to one skilled in the art that the role of each exchanger is reversed when the heat pump mode of operation is reversed whereby the indoor heat exchanger serves as a condenser and the outdoor heat exchanger acts as an evaporator when the system is placed in the heating mode.

Figure 2:
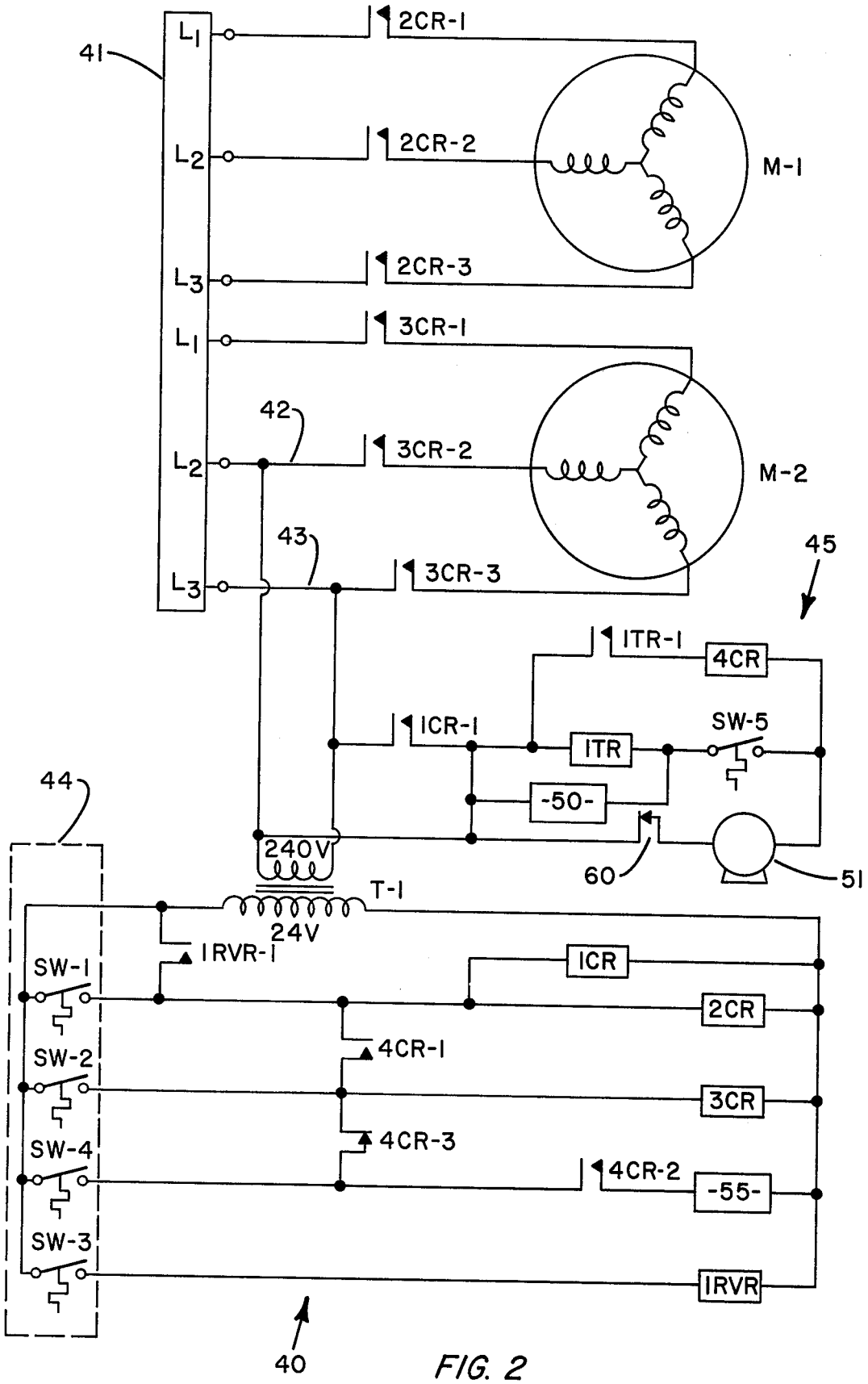
FIG. 2 is an electrical diagram illustrating circuit means for regulating the operation of the compressors utilized in the heat pump system shown in FIG. 1.

Turning now to FIG. 2, there is shown as electrical diagram of a control system 40 for staging the operation of the two compressors utilized in the present heat pump system. The motor designated M-1 in FIG. 2 is connected to compressor 19 as shown in FIG. 1 while the motor designated M-2 is connected to compressor reference 20 in FIG. 4. Each of the motors is wound for three phase operation with the individual windings being connected to a suitable 240 volt service 41 by means of terminals L-1, L-2 and L-3. Two of the lines connecting the motor M-2 to terminals L-2 and L-3 are electrically connected to one side of a step down transformer T-1 which is adapted to provide 24 volts over the secondary windings thereof.

A thermostat 44 is physically located in the area to be conditioned. As seen in FIG. 2, the thermostat is electrically wired into the 24 volt circuit on the low voltage side of transformer T-1. The thermostat contains four temperature sensitive switches SW-1 through SW-4. The first two switches, SW-1 and SW-2, are arranged to control the staging of the two compressor motors when the heat pump system is placed in a cooling mode of operation. Switches SW-3 and SW-4 are utilized to control the staging of the motor compressors when the system is in a heating mode of operation. The cooling mode switches Sw-1 and SW-2 are arranged to close when the temperature in the conditioned area is rising. The heating mode switches SW-3 and SW-4 on the other hand are arranged to close when the temperature in the conditioned area is falling. Switch SW-1 is preset to close at a temperature that is between three and five degrees lower than the closing temperature of switch SW-2 so that the switches are closed in an ordered sequence as the temperature in the conditioned area rises. By the same token, heating switch SW-3 is preset to close at a slightly higher temperature than the closing temperature of second heating switch SW-4 whereby the heating switches also close in an ordered sequence when the temperature in the conditioned region is falling.

Turning first to the cooling mode of operation, solenoid actuated reversing valves 21 and 23, (FIG. 1) associated with the two refrigeration circuits are automatically placed in a position to direct refrigerant through the two circuits wherein the two outdoor coil 13, 14 act as condensers in the respective circuits and the two indoor coils 16, 17 act as evaporators. As the temperature within the conditioned region rises, the first cooling switch SW-1 closes. Closure of this switch causes relays 1CR and 2CR to become energized. The energization of 2CR pulls in contacts 2CR-1, 2CR-2, and 2CR-3 in the windings of motor M-1 thereby actuating the motor and bringing the first refrigerant circuit associated with compressor 19 on line. Relay 1CR, when energized, also pulls in contact 1CR-1 in a defrost control circuit 45. Current flow through this circuit, however, is precluded until such time as a second thermal sensitive switch SW-5, which is wired in series with 1CR-1, is also closed. As will be explained in greater detail below, switch SW-5 is operatively associated with both coils of the outdoor heat exchanger and is arranged to close only when ambient temperatures are low enough to produce icing on the surfaces of the outside coils. In effect, switch SW-5 locks-out the defrost circuit when the heat pump is providing cooling to the conditioned region.

As can be seen, with switch SW-1 closed, only one of the two refrigeration circuits is operating to provide cooling. A continued rise in the temperature within the conditioned region, typically a rise of between three to five degrees, causes the second thermostat switch SW-2 to also close. As best seen in FIG. 2, closure of switch SW-2 provides an electrical path by which current energizes relay 3CR. This, in turn, causes contacts 3CR-1, 3CR-2 and 3CR-3 in the windings of motor M-2 to be pulled closed thus placing the second refrigeration circuit in operation to augment the first circuit in meeting the cooling demands placed upon the heat pump system.

A drop in the outdoor temperature will produce a corresponding drop in the indoor temperature thus causing switches SW-1 and SW-2 to open inactivating the heat pump system. A continued drop in temperature causes thermostat switch SW-3 to close thereby energizing reversing valve relay 1RVR in the 24 volt circuit. This relay, when energized, serves a two fold function. Although not shown energization of 1RVR causes the coils associated with the solenoid actuated reversing valves 21, 23 (FIG. 1) to become energized reversing the functions of the two refrigeration circuits. The two outdoor coils now function as evaporators in their respective circuits and the indoor coils function as condensers. Energization of 1RVR also closes contact 1RVR-1 in the 24 volt circuit. Contact 1RVR-1, when closed acts as a shunt to by pass switch SW-1 and permit 1CR and 2CR to become energized.

As explained above, the energization of 2CR causes the first refrigeration circuit driven by compressor 19 and, because of the reversal of the four-way valves, produces heating in the conditioned region. The energization of the second relay, 1CR, closes one of the two starting switches located in the defrost circuit. For the time being, it will be assumed that the ambient temperature is sufficiently high enough that switch SW-5 will remain open and the defrost circuit is being held inactive while the conditioned region is being heated by the heat pump system.

If the temperature in the conditioned region continues to fall, the second heating mode switch SW-4 in thermostat 44 is sequentially closed along with switch SW-3. When this occurs, current is permitted to flow through normally closed contact 4CR-3 thus energizing relay 3CR. Again, as explained above, the energization of this relay causes contacts 3CR-1, 3CR-2 and 3CR-3 in the windings of motor M2 to be pulled closed thereby placing the second refrigeration circuit in operation along with the first. It should be noted at this time that one or both of the two refrigeration circuits can be brought sequentially into operation to provide heating when the ambient conditions are such that switch SW-5 remains open, that is, when the defrost circuit is being held inactive.

Figure 3:
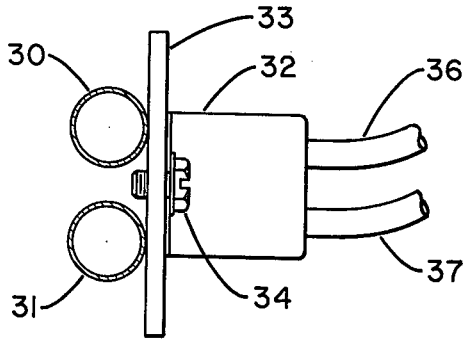
FIG. 3 is an enlarged side view of a temperature sensing device for detecting the temperature of refrigerant leaving the outdoor heat exchanger associated with the heat pump system shown in FIG. 1.

In the present device, the thermal switch SW-5 is adapted to close when ice begins to form on the surfaces of the outdoor coil 13, 14. The switch is arranged to respond to a predetermined average temperature sensed in refrigerant entering both of the outdoor coils. As best seen in FIGS. 1 and 3, a temperature sensing element 32, capable of converting a sensed temperature into an electrical signal, is mounted upon a plate 33 by means of screws 34. The plate, in turn, is bonded, either adhesively or metallurgically, to both of the refrigeration lines 30, 31 extending between the indoor and outdoor heat exchangers with the plates being positioned in close proximity to the inlet terminals of both outdoor coils. The plate 33 is formed of a material having good heat transfer characteristics, as are the refrigeration lines 30, 31. Accordingly, the sensing probe of the temperature sensor, which is positioned in contact against the plate, is capable of rapidly and efficiently detecting the average temperature of the refrigerant entering both coils. An electric signal indicative of the sensed temperature is sent via lines 36, 37 to the control circuitry 40. As is well known, a relationship exists between ambient temperature and the refrigerant discharge temperature whereby the defrost cycle can be initiated in response to the predetermined refrigerant temperature to prevent the outdoor coils from becoming iced up.

Referring once again to FIG. 2, when a refrigerant temperature is sensed which indicates that coil icing shall occur, switch SW-5 in the defrost circuit 45 is closed. At this time, time delay relay 1TR is energized. This, in turn, produces a closure of contact 1TR-1 and energizes slave relay 4CR. The energized slave relay closes normally opened contact 4CR-1, and opens contact 4CR-3 in the 24 volt circuit. As can be seen, with the 24 volt circuit in this configuration, relay 3CR becomes energized regardless of the position of thermal switch SW-4 thus insuring that the second compressor motor is operating any time a defrost cycle is enabled.

With current flowing to the defrost circuit, the defrost system 50 is also actuated. The defrost system can be of any suitable type that is known and used in the art for removing ice from the surface of the outdoor coil. It is contemplated that the defrost system of the type wherein the four-way reversing valves in the two refrigeration circuits need not be repositioned to initiate a defrost cycle as for example the defrost system disclosed in U.S. Pat. No. 3,677,025. As is typical in most defrost systems, the fan associated with the outdoor coil is inactivated during the defrost cycle. To this end, a normally closed contact 60 is opened when the defrost cycle is initiated by defrost system 50 which inactivates the fan motor 51.

With the energization of relay 4CR, contact 4CR-2 is also pulled closed in the 24 volt circuit. This allows power to reach auxiliary heating device 55 when heating mode switch SW-4 in the thermostat 44 is closed. As can be seen, the auxiliary heater can therefore only be actuated after the second compressor is sequenced into operation and the ambient temperature conditions are sufficiently low enough to produce icing on the outdoor coil. The auxiliary heater therefore is precluded from being cycled to an on condition during those periods when the more efficient heat pump system can independently handle the heating loads placed on the system. This, in turn, reduces, the amount of energy required to heat the conditioned area.

Upon the termination of the defrost cycle, SW-5 will open thereby inactivating the defrost system 50. The time delay relay 1TR, however, remains energized holding the two compressors active and permitting the auxiliary heater to operate if required. The drop-out time of the time delay relay is such that it will permit the themal sensitive switch SW-5 to once again close if outdoor heat exchanger icing persists. This in turn prevents unwanted cycling of compressor 20, associated with the second circuit, caused by the unwanted energization of relay 4CR. If icing conditions are not present SW-5 will not reclose and 1TR-1 will be deenergized returning the system to the mode of operation demanded by the thermostat.

While this invention has been disclosed with reference to the detailed description above, it is not confined to the details as set forth and this application is intended to cover any modifications or changes as may come within the scope of the following claims.

What is claimed is:

1. In a heat pump system having more than one compressor operatively connected to an indoor heat exchanger for providing both heating and cooling within a conditioned region and an outdoor heat exchanger, defrost means arranged to remove ice from the outdoor heat exchanger, and thermostat means in the conditioned region to start the compressors in sequence as the temperature in the conditioned region rises and falls through a series of preset temperature levels, the improvement comprising a defrost control circuit which, when compressor is energized in the heating mode of operation activates defrost means to initiate a defrost cycle and overrides the thermostat means to effect starting of at least one additional compressor regardless of the temperature within the conditioned region, first and second contact means in the control circuit which, when enabled, causes the control circuit to be energized, means to enable said first contact when the first compressor in the sequence is operating, and means to enable the second contact when the outdoor heat exchanger is exposed to icing conditions.

2. The heat pump system of claim 1 wherein the means to enable said second switch is a thermal detector positioned adjacent to the outdoor coil.

3. The heat pump system of claim 2 wherein the thermal detector is placed in contact with the refrigerant line through which refrigerant enters the outdoor heat exchanger

4. The heat pump system of claim 1 further including auxiliary heating means associated therewith for providing additional heat to the conditioned region and switching means responsive to the thermostat for activating the auxiliary heating means after all the compressors in the sequence are activated.

5. The heat pump system of claim 1 further including reversing means associated with the thermostat means for reversing the function of the heat pump from a cooling to heating mode when the temperature in the conditioned region falls to a predetermined temperature level.

6. The heat pump system of claim 1 wherein the defrost control circuit includes an electric relay which is arranged to be energized by the closure of the first and second contacts, and switching means responsive to the energization of said relay for overriding the thermostat means and starting said compressors.

* * * * *